US008376195B2

(12) United States Patent
Dubach

(10) Patent No.: US 8,376,195 B2
(45) Date of Patent: Feb. 19, 2013

(54) PLASTIC CLOSURE FOR DISPENSING THIXOTROPIC FLUIDS

(75) Inventor: Werner Dubach, Maur (CH)

(73) Assignee: Deltona Innovations AG, Maur (CH)

( * ) Notice: Subject to any disclaimer, the term of this patent is extended or adjusted under 35 U.S.C. 154(b) by 240 days.

(21) Appl. No.: 12/734,121

(22) PCT Filed: Sep. 22, 2008

(86) PCT No.: PCT/CH2008/000392

§ 371 (c)(1),
(2), (4) Date: Jul. 12, 2010

(87) PCT Pub. No.: WO2009/046551

PCT Pub. Date: Apr. 16, 2009

(65) Prior Publication Data

US 2010/0320235 A1 Dec. 23, 2010

(30) Foreign Application Priority Data

Oct. 10, 2007 (CH) ..... 1568/07

(51) Int. Cl.
*B67D 3/00* (2006.01)

(52) U.S. Cl. ..... 222/547; 215/307; 220/374; 222/212; 222/546

(58) Field of Classification Search ..... 215/307; 220/374; 222/212, 454, 544–547, 571
See application file for complete search history.

(56) References Cited

U.S. PATENT DOCUMENTS

| | | | | |
|---|---|---|---|---|
| 2,175,052 | A | 10/1939 | Bull et al. | |
| 4,433,800 | A * | 2/1984 | Owens | 222/547 |
| 4,460,101 | A | 7/1984 | Tseng | |
| 4,600,112 | A * | 7/1986 | Shillington et al. | 215/274 |
| 4,826,055 | A * | 5/1989 | Stull | 222/524 |
| 6,318,606 | B1 * | 11/2001 | Buehler | 222/565 |
| 6,412,664 | B1 | 7/2002 | Wolff et al. | |
| 6,848,603 | B2 * | 2/2005 | Gaiser et al. | 222/153.1 |
| 7,014,075 | B2 * | 3/2006 | Bonifacio et al. | 222/503 |
| 2010/0072231 | A1 * | 3/2010 | Bloom et al. | 222/547 |
| 2011/0000870 | A1 * | 1/2011 | Dubach | 215/228 |

FOREIGN PATENT DOCUMENTS

| | | | |
|---|---|---|---|
| DE | 85 18 074.2 | | 2/1986 |
| DE | 196 40 629 | A1 | 4/1998 |
| EP | 0 442 379 | A2 | 8/1991 |
| EP | 0 545 678 | A2 | 6/1993 |
| EP | 1 216 932 | A1 | 6/2002 |
| GB | 951533 | | 3/1964 |
| GB | 2389357 | A * | 12/2003 |
| WO | WO 2006/119315 | A2 | 11/2006 |

OTHER PUBLICATIONS

Co-Pending U.S. Appl. No. 12/734,122; inventor Werner Dubach; title Plastic Closure.

* cited by examiner

*Primary Examiner* — Kevin P Shaver
*Assistant Examiner* — Patrick M Buechner
(74) *Attorney, Agent, or Firm* — Pauley Petersen & Erickson

(57) ABSTRACT

A plastic closure for dispensing thixotropic fluids from a flexible bottle. The closure has a bottom part including a cover surface with a spout opening Beneath the cover surface a support surface in which several axially extending through-passages are disposed, which are radially offset relative to the spout opening. The support surface includes partial elements in the form of tongues, which are integrally formed on an annular jacket wall by way of integral hinges which engage in a pin in the installed state. This results in a closure that can be manufactured particularly inexpensively, is simple to install, and can be produced in one piece.

13 Claims, 5 Drawing Sheets

PLASTIC CLOSURE FOR DISPENSING THIXOTROPIC FLUIDS

BACKGROUND OF THE INVENTION

1. Field of the Invention

This invention relates to a one-part or a multipart plastic closure for fastening to the neck of a flexible bottle for dispensing thixotropic fluids, having a bottom part with a circumference wall and a top surface into which a pouring opening is formed.

2. Discussion of Related Art

Thixotropic fluids are fluids with a non-Newtonian flow behavior. A typical example of such a fluid is ketchup. Various liquid soaps also exhibit thixotropic behavior, as do many dispersions. Today, such fluids are sold in flexible plastic containers having closures with a so-called closure membrane. There are many known embodiments of closures with a so-called closure membrane. Examples include those taught by European Patent References EP-A-545 678 and EP-A-442 379, and also U.S. Pat. No. 2,175,052. The significant advantage of closures having a closure membrane is that the already open container can be stood on its head without the fluid leaking out of it. Pressure exerted on the flexible bottle deforms the closure membrane, as described in PCT International Application WO 2006/11915, or the usually slit-shaped opening spreads open and the fluid can be squeezed out of the bottle, as described in the above-mentioned documents. In this case, one problem arises if the membrane is tautly held, for a better closing force and the quicker the closure closes when the pressure on the container is released. As a result, an ever more powerful vacuum builds up in the container over time so that the bottle becomes more and more deformed as its contents are consumed and also the pressure required to dispense the fluid is increased. If the closure membrane is stretched less tautly, then at least sometimes, a certain amount of the displaced air can flow back into the container. Thus, the closure also tends to drip. Furthermore, the more tautly the closure membrane is stretched, the more the closure tends to open explosively when pressure is exerted, causing a jet to emerge at high velocity and the container to have a tendency to spray.

In order to reduce this problem, a variety of complex known closure membrane closures have a design of the closure membrane which is more and more complex and the very small component requires more and more effort to install it in the closure. With these complex closure membranes, it is possible to produce a closing action and an opening of the slit-shaped closure as soon as a pressure difference exists between the atmosphere and the internal pressure of the bottle. This possibility assures the venting of plastic bottles. But because of the variety of materials that must be used in these plastic bottles with closure membranes, such as the membrane must usually be made of a silicone rubber and the actual closure must be produced from a polypropylene, it is not possible to produce them in one injection procedure in the same machine. Also, the silicone rubber part is a relatively expensive part and for this reason alone, it is desirable for it to be as small as possible. When this part is small, however, and is at the same time highly flexible, its installation by machine is extremely complex and malfunction-prone.

The plastic closures mentioned here, which have closure membranes, are known, for example, from European Patent Reference EP 1 216 932 or German Patent Reference DE-A-196 406 29. Closures of this kind are suitable not only for thixotropic fluids, but also for practically all fluids, with the exception of very low-viscosity fluids or carbonated fluids.

Development of the closure according to this invention is for providing a closure that avoids the above-mentioned disadvantages, but is simultaneously limited to the use of thixotropic fluids. Thixotropy is understood as the property of a non-Newtonian fluid in which the viscosity decreases in response to constant shear stress over a certain period of time. After the shear stress stops, the initial viscosity is reestablished. In other words, the longer a thixotropic fluid is moved, the lower its viscosity becomes. Normally, the faster the movement is carried out, the faster the viscosity decreases. In other words, in such a closure, the flow-through direction is changed and the flow is accelerated, thus achieving a good flow capacity of the thixotropic fluid while at the same time, a simple shut-off in the flow direction suffices to prevent leakage at a lower viscosity. This invention makes use of this knowledge, creating a plastic closure that is extremely economical, simple to manufacture and assemble, and that can even be manufactured in one piece.

SUMMARY OF THE INVENTION

One object of this invention is to provide a closure that makes simple use of the flow behavior of thixotropic fluids and which is based on a plastic closure having embodiments disclosed in this specification and in the claims.

BRIEF DESCRIPTION OF THE DRAWINGS

One preferred embodiment of this invention is shown in the drawings and is explained in view of the following description taken in conjunction with the accompanying drawings, wherein.

DETAILED DESCRIPTION OF THE INVENTION

Figure 1:
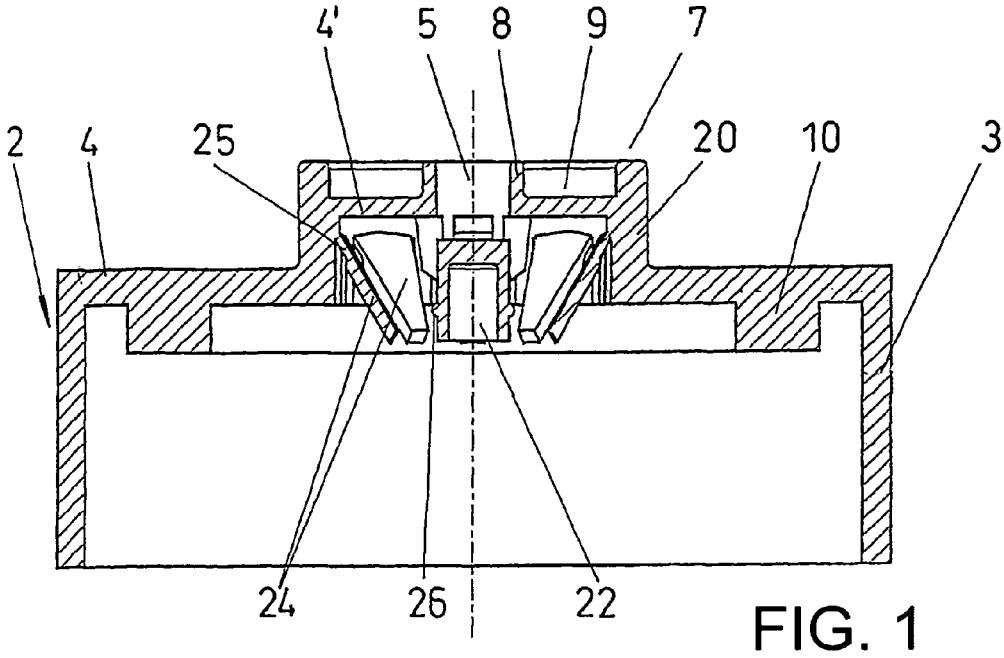
FIG. 1 shows a diametrical, vertical section taken through a bottom part of a plastic closure according to an embodiment of this invention, in a position in which it is produced in a mold for injection molding plastic.

In the embodiment shown, the plastic closure is labeled as a whole or in its entirety with the reference numeral 1 and the bottom part is labeled 2. The bottom part 2 has a circumference wall 3 that is closed at the end by a top surface 4. A pouring opening 5 is formed into the top surface 4. The top surface 4, as shown in the drawings, can have a raised area 7. If such a raised area 7 is not desired, then the same invention can still be easily implemented in a practical fashion by shifting the entire structure of the raised area 7, with all of the elements below the top surface 4 accommodated therein, in the direction toward the bottle neck. A variant of this kind, however, is not shown in the drawings but can result in the same depiction in which the raised area as a whole is simply shifted downward until its upper surface or top surface 4' is flush with the top surface 4 of the bottom part 2. The top surface 4 has an annular retaining bead 10 formed onto its underside. It is used to produce a seal in relation to the bottle neck and can be used for fastening a sealing foil 30.

In this embodiment, an annular groove 9 around the pouring opening 5 is formed into the top surface 4' of the raised area 7 which forms a spout 8. In the example shown, however, the spout 8 does not extend below the top surface 4' of the raised area 7. The raised area 7 has a circumferential wall 20 extending around it. In the axial extension of the pouring opening 5 and approximately flush with its inner wall, a plurality of struts 21 that likewise extend in the axial direction are formed onto the underside of the top surface 4' of the raised area 7. These axial struts 21 are shown extending in the cutting plane in FIG. 2. Usually, approximately four such struts 21 are provided. These struts hold a hollow plug 22 that is closed at the top. The hollow plug 22 has a covering 23. The diameter of the plug 22 is at least approximately the same size as that of the pouring opening 5.

Partial elements of the support surface 12 are formed onto the inside of the surrounding circumference wall 20 of the raised area 7. In this instance, these partial elements are embodied in the form of or formed as pivoting tabs 24. The tabs 24, which as mentioned above are partial elements of the support surface 12, are attached to the inner surface of the annular circumferential wall 20 of the raised area 7, preferably by film hinges 25. The flexible film hinges 25 permit the tabs 24 to move toward the plug 22 and wedge against the hollow plug 22. This produces a frictional, nonpositive connection. Preferably, however, a circumferential support bead 26 is formed onto the sealing plug. The support bead 26 assures that the tabs 24 are held against the hollow plug 22 not only in a frictional, nonpositive way, but also in a detent-engaged and therefore form-locked fashion.

In principle, the tabs could be embodied so that they come to rest against one another in a completely sealed fashion. If so, it would then be necessary for axially extending through openings 13 to be formed into the tabs 24. This is in fact a possible variant, but is rather complex from a technical manufacturing standpoint. Instead, the tabs 24 are embodied as slightly narrower so that slot-shaped through openings 27 remain between them. The slot-shaped through openings 27 form axially extending through openings. The support surface 12 is thus on the one hand composed of the covering 23 of the hollow plug 22 and on the other hand, composed of the tabs 24 that constitute or form partial elements of the support surface 12.

Figure 2:
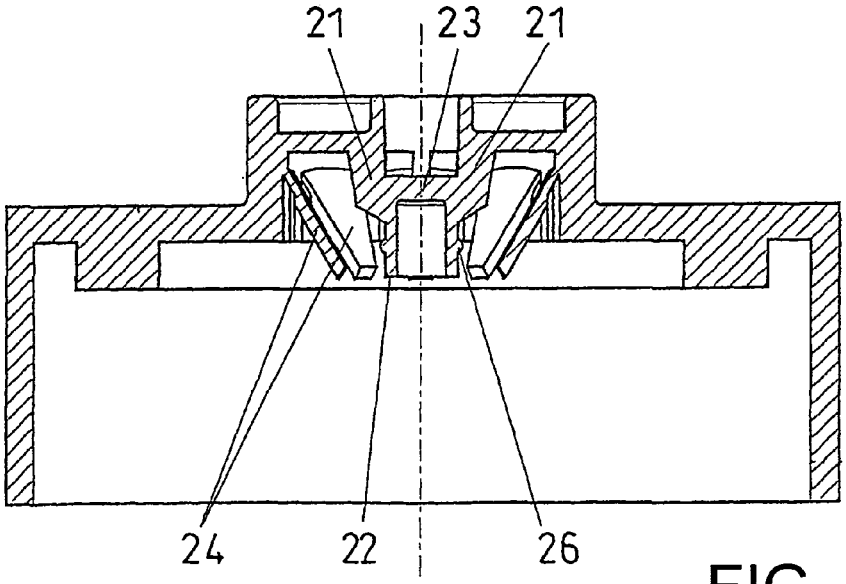
FIG. 2 shows a similar view of the same bottom part according to FIG. 1 in the same position, but rotated by an angle of 45°.

As mentioned in the brief description of the drawings, FIGS. 1 and 2 show the manufacturing position of the bottom part 2. In this manufacturing or injection-molding position, the tabs 24 extend diagonally downward toward the central axis. To achieve this, it is sufficient to have a central, separately movable part in the bottom part of the injection mold. After the mold is opened, the outer part is first removed while the inner part of the mold remains in position. If the outer part of the lower mold is removed, then the inner part of the lower injection mold can be withdrawn, which is accompanied by the tabs 24 pivoting outward at the same time.

Figure 5:
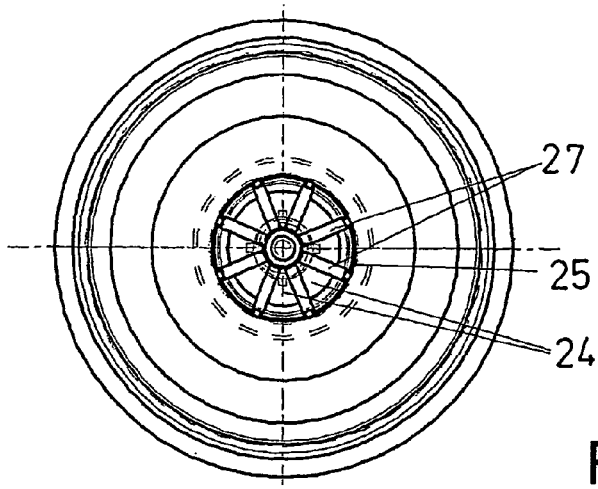
FIG. 5 shows the plastic closure with indifferently situated tabs, in an installed state or utilization position, viewed from underneath.

In this embodiment according to this invention, a chamber 17 is formed beneath the top surface 4' of the raised area 7 and above the support surface 12 that is formed by the tabs 24. In this case, the static, hydraulic pressure of the bottle contents rests against the support surface 12 and as a result of the non-Newtonian flow behavior, the thixotropic fluid does not flow out, even when the closure is in the open state. When a pressure is exerted on the flexible container, the thixotropic fluid flows through the slot-shaped through openings 27 that are shown most clearly in FIG. 5. Flowing in the axial direction, the fluid then travels into the chamber 17, filling the chamber, whereupon the fluid flows between the struts 21 and the hollow plug. The narrowing causes a Bernoulli effect and when the flexible bottle returns to its original shape, the Venturi principle causes the chamber 17 to be practically emptied. In order for these effects to occur, the cross-sectional area of the pouring opening 5 is smaller than the sum of the areas of the slot-shape through openings 27. With regard to the chamber 17, the through openings 27 are larger in the outflow direction than the cross-sectional area of the pouring opening 5. In the outflow direction, assurance is thus provided that despite the thixotropy of the fluid, the forces required to push the fluid out of the bottle do not become excessively great, which would be the case, for example, with labyrinth-like outflow openings of the kind normally provided, for example, in certain dispensing devices. In the opposite direction, as air is returned into the bottle in a volume corresponding to the displaced volume, the size ratios of the pouring opening and the through openings 27 achieves a high flow speed. This is implemented in a particularly optimal fashion by the cross-sectional narrowings.

Figure 3:
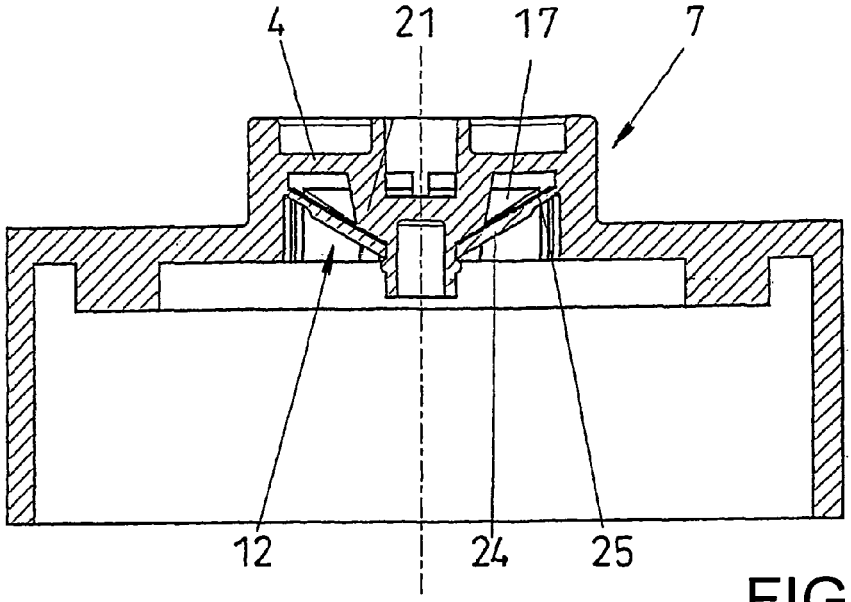
FIG. 3 shows the bottom part shown in FIG. 2, but in the utilization position.
Figure 4:
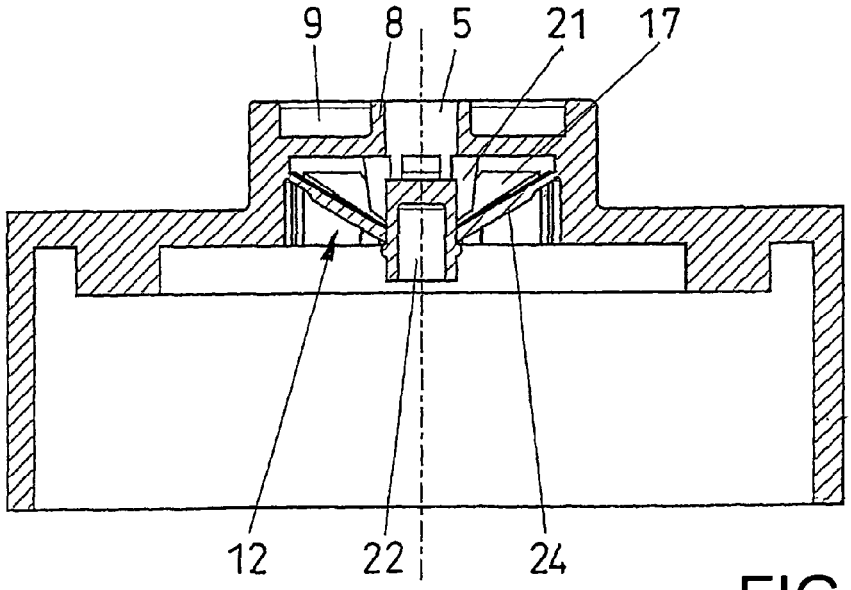
FIG. 4 shows the bottom part according to FIG. 1, likewise in the utilization position.
Figure 6:
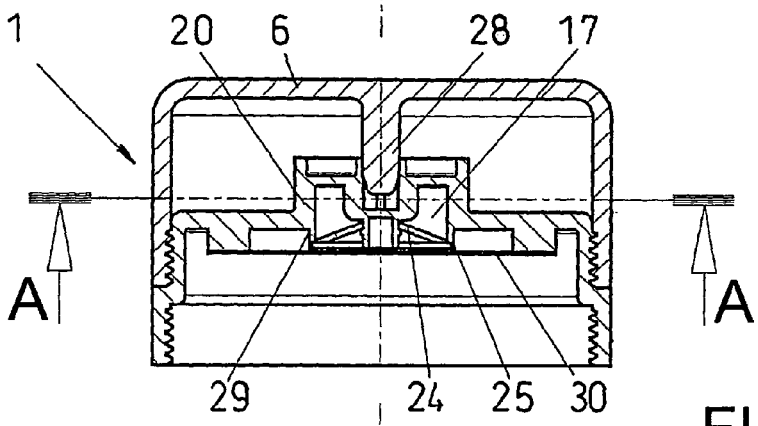
FIG. 6 shows a vertical, diametrical section in a completely assembled state, provided with a cover.
Figure 7:
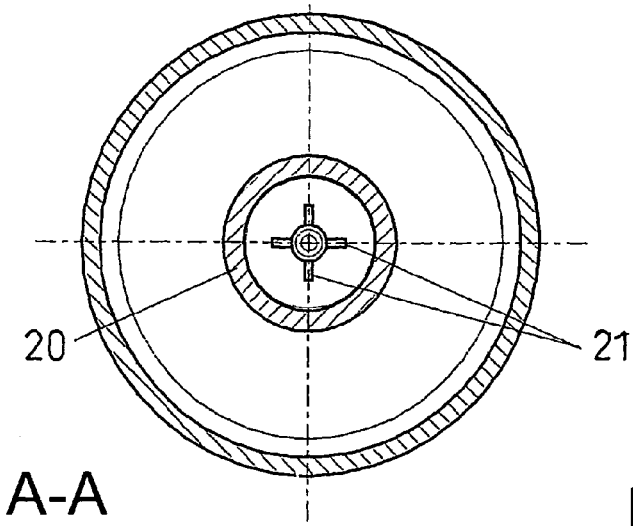
FIG. 7 is a horizontal section along the line A-A, according to FIG. 6.
Figure 8:
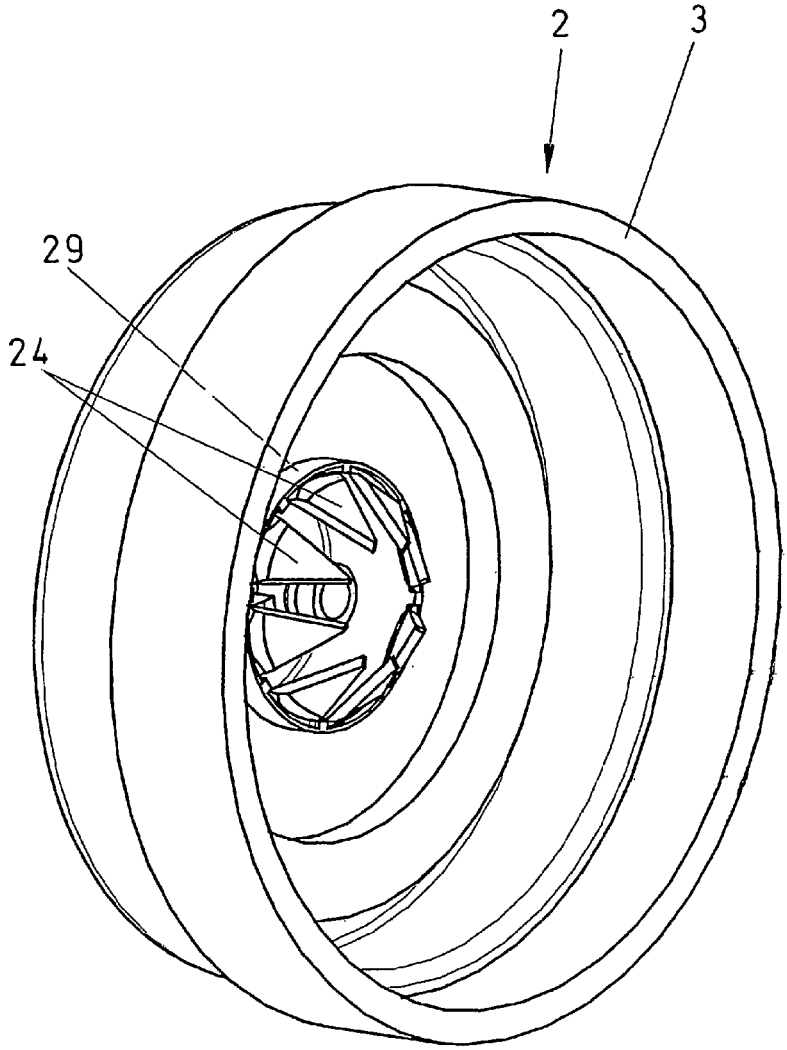
FIG. 8 is a perspective view of the bottom part of a plastic closure, in the position according to FIG. 1, but in the embodiment according to FIGS. 5 through 7.
Figure 9:
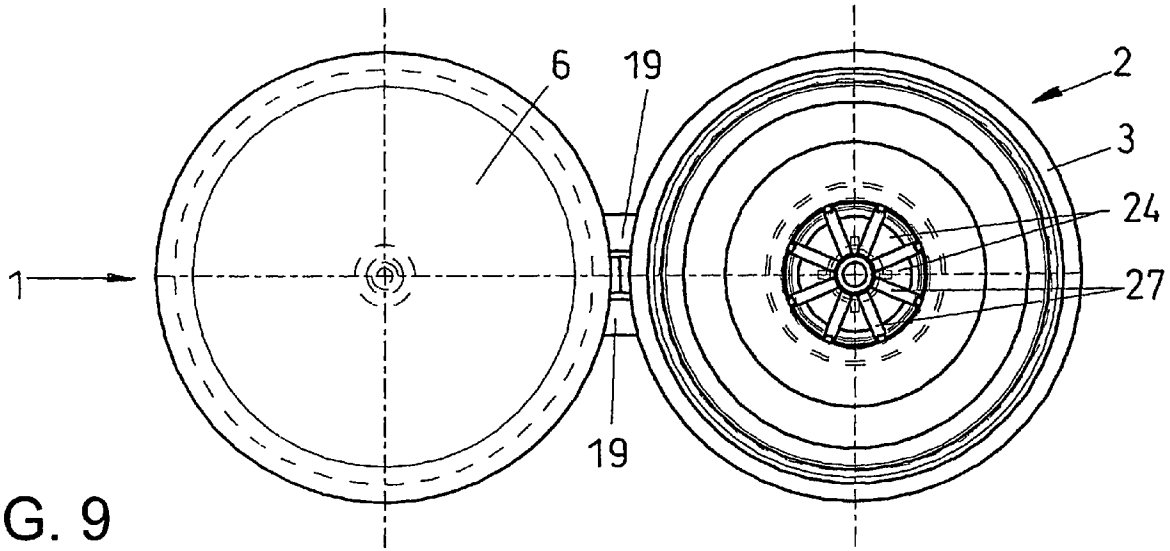
FIG. 9 shows a one-piece plastic closure in an assembled state, with a cover in the open position.
Figure 10:
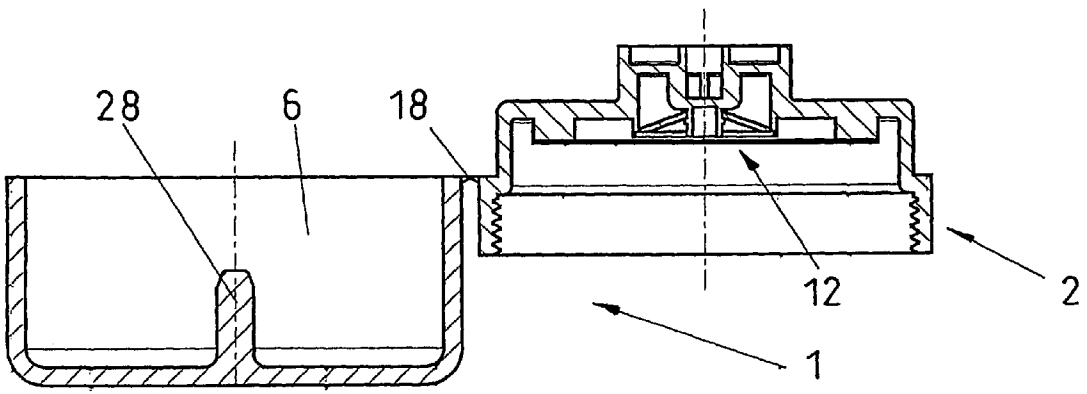
FIG. 10 is a diametrical, vertical section taken through the same plastic closure according to FIG. 9.

As mentioned above, FIGS. 9 and 10 show a one-piece hinged closure made of plastic. It is injection, molded in one piece and in this case, the cover 6 is attached by a film hinge 18 with tautening bands 19 connected to it. In this form, the plastic closure constitutes or forms a snapping hinged closure. In addition, a sealing pin 28 is formed onto the inside of the cover 6 and in the closed state of the closure, engages in the pouring opening 5 in a sealed fashion. This is shown in FIG. 6, which shows a vertical, diametrical section taken through a two-part plastic closure in the closed state. In this case, it is not a hinged closure or snapping hinged closure, but is instead a simple screw connection. In particular in FIG. 6, which depicts a section along the line A-A, the arrangement of the struts 21 is also clearly visible. The radial flow above the support surface 12 into the pouring opening 5 passes between the struts 21. FIG. 6 shows that in this embodiment, the tabs 24 are not formed onto the inner wall of the annular circumference wall 20 but instead, the annular circumference wall 20 has a slight downward-oriented extension 29 and the tabs 24 are in turn formed onto its lower, peripheral edge by film hinges 25. Correspondingly, this embodiment has a slightly different appearance in the non-installed position in a perspective view as shown in FIG. 8. Otherwise, this embodiment shown in FIGS. 5 through 10 is nearly equivalent to the one shown in FIGS. 1 through 4. Due to the different arrangement of the tabs 24, the support surfaces in the two variants mentioned are oriented differently from each other. In one case, the support surface 12 extends in the form of a funnel pointing upward, as shown in FIGS. 3 and 4, while in the other case, the support surface 12 is formed as a funnel, but with the wide opening oriented toward the bottle neck. This does not, however, affect the function of the plastic closure according to this invention.

The invention claimed is:

1. A one-part or multipart plastic closure (1) for fastening to a neck of a flexible bottle for dispensing thixotropic fluids, comprising a bottom part (2) with a circumference wall (3) and a top surface (4) into which a pouring opening (5) is formed; below and spaced apart from the top surface (4) in an axial direction is a support surface (12) which closes off a free axial passage from the container neck to the pouring opening (5); and the support surface (12) has axially extending through openings (27), which are radially offset in relation to the pouring opening (5), and the support surface (12) is formed of one piece with the bottom part (2) and is of partial elements and of a surface (23) of a central plug (22); wherein the partial elements are pivoting tabs (24) formed onto an annular circumference wall (20) by film hinges (25).

2. The plastic closure as recited in claim 1, wherein a sum of the cross-sectional areas of all of the axially extending through openings (27) is greater than or equal to a cross-sectional area of the outlet opening (5).

3. The plastic closure as recited in claim 1, wherein the top surface (4) has a raised area (7) in which the pouring opening (5) is formed as a spout (8).

4. The plastic closure as recited in claim 3, wherein the support surface (12) is positioned beneath the raised area (7).

5. The plastic closure as recited in claim 3, wherein the annular circumference wall (20) delimits the raised area (7) and extends below the top surface (4).

6. The plastic closure as recited in claim 5, wherein below the pouring opening, axially extending struts (21) secure the plug (22) against which the freely movable ends of the pivoting tabs (24) rest in a detent fashion in an assembled state of the closure (1).

7. The plastic closure as recited in claim 6, wherein the plug (22) has an annular bead (26) against which the tabs rest in a supported fashion.

8. The plastic closure as recited in claim 5, wherein the through openings (27) are formed as slots between the tabs (24).

9. The plastic closure as recited in claim 3, wherein an annular groove (9) extends around the pouring opening (5) in the top surface (4') of the raised area (7).

10. The plastic closure as recited in claim 1, wherein the through openings are formed into the partial elements or the tabs (24).

11. The plastic closure as recited in claim 1, wherein below the pouring opening, axially extending struts (21) secure the plug (22) against which the freely movable ends of the pivoting tabs (24) rest in a detent fashion in an assembled state of the closure (1).

12. The plastic closure as recited in claim 1, wherein the through openings (27) are formed as slots between the tabs (24).

13. The plastic closure as recited in claim 1, wherein the plug (22) has an annular bead (26) against which the tabs rest in a supported fashion.

* * * * *